US006345412B1

(12) United States Patent
Law

(10) Patent No.: US 6,345,412 B1
(45) Date of Patent: Feb. 12, 2002

(54) ARRANGEMENT FOR CONTROLLING AN ANGULARLY MOVABLE MEMBER

(75) Inventor: Brian Robert Law, Leicester (GB)

(73) Assignee: Ingersoll-Rand Architectural Hardware Group Ltd., Birmingham (GB)

( * ) Notice: Subject to any disclaimer, the term of this patent is extended or adjusted under 35 U.S.C. 154(b) by 0 days.

(21) Appl. No.: 09/446,371

(22) PCT Filed: Jun. 17, 1998

(86) PCT No.: PCT/GB98/01779

§ 371 Date: Dec. 20, 1999

§ 102(e) Date: Dec. 20, 1999

(87) PCT Pub. No.: WO99/00573

PCT Pub. Date: Jan. 7, 1999

(30) Foreign Application Priority Data

Jun. 27, 1997 (GB) ..... 9713487

(51) Int. Cl.[7] ..... E05F 1/08
(52) U.S. Cl. ..... 16/72
(58) Field of Search ..... 16/72, 75, 76, 16/54, 58

(56) References Cited

U.S. PATENT DOCUMENTS

| | | | | |
|---|---|---|---|---|
| 3,777,423 A | * | 12/1973 | Coulter et al. | 49/31 |
| 6,205,619 B1 | * | 3/2001 | Jang | 16/54 |

FOREIGN PATENT DOCUMENTS

| | | | | |
|---|---|---|---|---|
| EP | 207251 | * | 1/1987 | 16/72 |
| EP | 0 808 983 A1 | | 11/1997 | |
| GB | 2180294 | * | 3/1987 | 16/72 |
| GB | 2278882 | * | 12/1994 | 16/72 |

* cited by examiner

*Primary Examiner*—Jerry Redman
(74) *Attorney, Agent, or Firm*—Michael Best & Friedrich LLP

(57) ABSTRACT

A control mechanism for use with a door closer having a pinion shaft. The control mechanism comprises a coiled torsion spring around the shaft with a free end of the spring lying along part of a strap. The strap is connected to the shaft and normally held in tension, in use, by its connection to a movable hydraulic piston of the door closer which is biased in one direction. On normal closing of the door, in use, the strap remains tensioned and the spring is thus prevented from tightening on the shaft. However, if an external closing force is applied to the door, the strap becomes untensioned, thereby allowing the spring to tighten about the shaft to retard its angular door closing movement.

9 Claims, 2 Drawing Sheets

ARRANGEMENT FOR CONTROLLING AN ANGULARLY MOVABLE MEMBER

BACKGROUND OF THE INVENTION

This invention relates to an arrangement for controlling the movement of an angularly movable member, and has particular application to devices for controlling the movement of a wing, such as a door. Such devices include overhead door closers and floor springs.

An object of the invention is to provide an arrangement for controlling the movement of an angularly movable member in an effective manner.

According to the invention, there is provided a control mechanism for use with an angularly movable shaft, the control mechanism comprising:

- a torsion spring, the shaft being positioned within the torsion spring; and
- a retarding means for tightening the torsion spring about the shaft, the tightening of the torsion spring retarding the angular movement of the shaft.

Preferably the retarding means of the control mechanism moves a free end of the torsion spring to tighten the torsion spring about the shaft.

Conveniently the retarding means comprises:

- a strap connected to the shaft;
- a movable hydraulic piston connected to the strap, the piston normally holding the strap in tension relative to the torsion spring, the strap, when in tension, preventing the torsion spring from tightening about the shaft.

Desirably the shaft includes a first portion having a circular cross-sectional shape, the torsion spring being positioned about the first portion, and a second portion having a shaped cam surface to vary the output torque, the strap being connected to the second portion.

More preferably the retarding means comprises:

- a linkage mechanism connected to one end of the torsion spring, the linkage mechanism being movable from a normal position to a retarding position, the movement of the linkage mechanism from the normal position to the retarding position tightening the torsion spring about the shaft.

BRIEF DESCRIPTION OF THE DRAWINGS

The invention will now be described, by way of example, with reference to the accompanying drawings, in which.

DETAILED DESCRIPTION OF THE DRAWINGS

Figure 1:
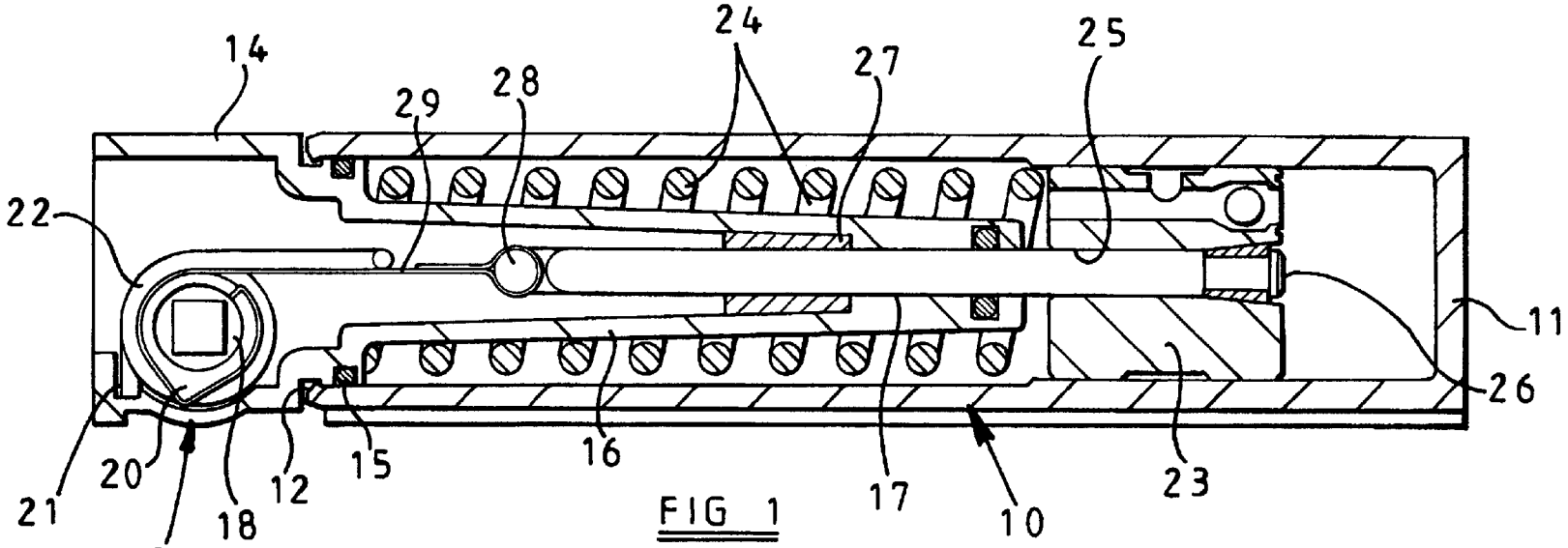
FIG. 1 is a schematic internal view from above of a door closer incorporating an arrangement of the invention, with a door associated with the closer being in an open state.

Whilst the present invention relates to an arrangement for controlling the movement of an angularly movable member generally, it has particular application to devices for controlling the movement of a pivoted wing, typically a door. Such devices include overhead door closers and floor springs, and the embodiment of the invention shown in the drawings relates to a hydraulic door closer in which, conventionally, a piston reciprocates in a cylinder as an associated door is open and closed, in order to transfer hydraulic fluid such as oil between compartments at respective opposite sides of the piston.

The door closer shown schematically in the drawings comprises a body formed of two parts, the first of these being a main body part 10 which is of hollow, elongated cylindrical form having a closed end 11 and an open end 12. Sealingly engaged with the body part 10 at its open end is a secondary body part 13 which has a generally cylindrical end portion 14 of the same outer diameter as the part 10. The body part 13 is fitted to the part 10 so that this end portion 14 substantially forms a continuation of the external cylindrical surface of the part 10. Internally the end portion 14 is twice stepped inwardly from the end portion 14 and at the exterior surface of the second step there is provided an O-ring seal 15 in an external annular groove, in order to seal the part 13 to the interior surface of the main body part 10. Extending further into the part 10 from the second internal step is an inwardly tapering portion 16 which extends for approximately two thirds of the length of the part 10. Adjacent its free end, the previously generally hollow portion 16 is internally thickened and provided with a circular section through-bore 17.

The secondary body part 13 is provided with appropriate bearings (not shown) for supporting an angularly movable pinion shaft 18 which, in normal use of the door closer, is vertical, and at 90° to the length of the closer body. The pinion is of constant diameter cylindrical form along the majority of its length, but at its upper end where it projects out of the secondary body part 13, it is formed with a square section as shown at 19 for connection of a conventional attachment arm or arm mechanism for operatively connecting the closer to the associated door. Moreover near its upper end, but within the secondary body part 13, the cylindrical shaft is formed with a shaped cam surface 20 for a purpose to be explained, this being in the form of an outwardly, generally radially, thickened lobe.

Adjacent the mounted pinion shaft 18, the body part 13 is formed with an associated arcuate inner surface, and between this arcuate surface and the end of the part 13 remote from the body part 10, there is formed a recess 21 which serves to retain therein one free end of a coiled torsion spring 22. The coils of the spring 22 are around the cylindrical part of the pinion shaft 18, below the position of the cam surface 20.

The main body part 10 is slightly stepped internally towards its closed end 11, and within this slightly reduced, constant internal diameter part is slidably disposed a piston 23 which is provided with flow passages in the conventional manner, there also being associated flow passages, valves and the like within the body part 10 for the transference of hydraulic fluid such as oil from one side of the piston to the other as the door associated with the door closer, in use, is opened and closed. This part of the closer is conventional and forms no part of the present invention. Disposed around the outside of the tapering portion 16 is a coiled compression spring 24, one end of which bears against an exterior shoulder of the body part 13 at the inner end of the tapering portion 16, the other end of the spring 24 bearing against a face of the piston 23 so as to bias it towards the closed end 11 of the body part 10. The piston has a central circular longitudinal bore 25 therethrough, and a circular section piston rod 26 has its one end held in this bore 25 by means of a tapered lock which wedges between the rod and a frusto-conical end part of the bore 25 at the end of the piston facing the closed end 11 of the body part 10.

The piston rod extends out of the opposite end of the piston and through the bore 17 into the open interior of the tapering portion 16. A bearing 27 is provided in the tapering portion 16 at the inner end of the through-bore 17 to allow for smooth reciprocation of the piston rod 26 as it moves back and forth with movement of the piston as will be described.

At its end within the portion 16, the piston rod is formed with an upstanding cylindrical projection 28 around which is secured as a loop, one end of a steel ribbon band or strap 29, this being disposed with its opposite edges in the same plane as the vertical axis, in use, of the shaft 18. The strap 29 extends from the piston rod to the part of the pinion shaft at which the cam surface 20 is disposed, and as can be seen from FIGS. 1 and 2, the strap is wrapped around this cam surface with its other end being turned through 90° and fitted into a recess in the shaft 18 so as to fix the strap to the pinion shaft.

As will be described, normal opening and closing movements of the associated door, taken in conjunction with the force of the restoring spring 24 ensure that the strap 29 is normally held tensioned, being straight, as shown in FIG. 1, so that it is in line with the axis of the piston rod, over its length between said rod and where the strap contacts the cylindrical surface of the pinion shaft cam surface part 20. In this position, as shown in FIG. 1, the free end of the coiled torsion spring 22, which is the uppermost end of this spring in use, lies along the straight strap 29 and engages it as illustrated. Although the force in the spring is such that this free end is attempting to 'coil-up' i.e. to move clockwise as viewed in the figures, the tension in the strap 29 is such as to resist this force upon it from the spring 22 and thus the equilibrium position shown in FIG. 1 is normally maintained, namely during normal opening and closing of the associated door.

In operation, the door closer will be fixed, for example, to an associated door, with a linkage from the square section 19 being connected to the door frame. In some arrangements, the fixing of the linkage and the door closer could of course be reversed with the door closer fixed to the frame. However in the closed position of the door the compression spring 24 will be in its fully extended position, forcing the piston 23 to its extreme right hand position so as to expel oil from the chamber formed at the right hand side of the piston. In this position, the piston rod will have been moved with the piston so that it lies in its extreme right hand position, and this will have caused an unwinding of the strap 29 from the cam surface 20, as the movement of the piston causes the corresponding angular movement, in the clockwise direction as viewed in FIG. 1, of the pinion shaft 18, via the connecting strap 29. The force of the restoring spring 24 is such that tension is constantly exerted on the strap via the intermediaries of the piston and the piston rod, so that the extended free end of the coiled spring 22 remains in contact with the strap in the disposition shown in FIG. 1.

In this state, the coils of the spring 22 are not tight against the cylindrical surface of the pinion shaft 18, and indeed these coils may be spaced slightly therefrom, so that there is free angular movement of the pinion, unrestricted by the surrounding torsion spring 22 under normal closer operation. Thus if the door is opened from its originally fully closed state, the opening movement will cause angular movement of the pinion shaft in the anticlockwise direction as viewed in FIG. 1. The piston, which is thus at its extreme right hand end of the body part 10, is moved to the left as the door is opened, against the bias of the spring 24, with the angular movement of the pinion shaft 18 causing the strap 29 to wrap around the cam surface 20, the connection between the strap and the piston rod causing the piston rod to move to the left as the pinion shaft rotates, thereby forcing the piston to the position shown in FIG. 1 where the spring 24 is compressed and the strap is wrapped around the surface 20. As the door is moved to its open position, for example at 90° as shown in FIG. 1, the free end of the spring 22 remains aligned along the strap 29 as shown in FIG. 1, as the strap is kept under tension by the angular movement of the pinion shaft against the restoring bias of the spring 24.

Thus in the door open position of FIG. 1, oil has transferred from the compartment at the left hand side of the piston to that at the right hand side in the normal manner, with resistance against door opening being provided by the spring 24 with or without some hydraulic assistance.

If the opening force on the door is then removed, the spring 24 will automatically move the piston 23 to the right, as viewed in FIG. 1, and via the connection from the piston to the pinion shaft 18 by way of the piston rod and the strap 29, this movement of the piston will cause the strap to unwind, with consequent angular movement of the pinion in the clockwise direction, resistance to closing of the door being effected by way of the resistance of the oil as it now flows from the compartment at the right hand side of the piston to the compartment at the left hand side thereof.

The provision of the shaped cam surface 20 is such as to provide a required torque profile to the opening and closing movements of the door in that by way of the thickened lobe, the unwinding and winding up of the strap 29 is controlled so that, for example, a different torque profile will be provided as compared, for example, with a pinion shaft which is purely cylindrical. In this manner it can be ensured that maximum torque is exerted, in use, at the pinion shaft when the spring 24 is in its least or substantially least energy storing state, corresponding to a closed or near closed position of the door. This arrangement is particularly advantageous where the linkage from the square section 19 is a single slide arm to a corresponding slide track at the door frame. This torque-control means, is of course, however, merely preferable, and is not essential to the invention.

As described with normal door opening and closing operation, the strap connection between the piston rod and the pinion shaft acts as a 'rigid' connection so that with every opening and closing movement the piston always moves in correspondence with the angular movement of the pinion shaft and thereafter the pinion shaft always moves in correspondence with the movement of the piston. However the invention relates to the control of an angularly movable shaft, in this case the pinion shaft 18, should an attempt be made to move it angularly at a rate greater than that at which it would normally move during door closing. In the application of the invention to a door closer, this is the situation which would occur if from its FIG. 1 position, where the door is fully open, an attempt was made to close the door too quickly by applying a closing force at the pinion shaft 18, for example by someone attempting to push the door closed. In other words an attempt to move the angularly movable pinion shaft in a clockwise direction at a rate greater than the normal door closing rate effected by the force of the spring on the piston 23.

In the event of this additional force being applied, the pinion shaft 18 will increase its angular movement with the result that, since the piston rod will still be moving at its normal door closing speed, the tension in the strap 29 will be reduced so that the strap will loosen. As a result of this reduction in the tension in the strap, the free end of the torsion spring 22 bearing on the strap will deflect it, to the position shown in FIG. 2, as this free end of the spring attempts to 'coil-up' as previously described. This 'coiling-up' process will cause the turns of the torsion spring 22 tightly to grip the cylindrical surface of the pinion shaft 18 thereby locking it against angular movement. The reduction in the tension in the strap thus allows the spring 22 to act as a brake, this braking effect automatically occurring once there is a break in the 'rigid' connection between the piston rod and the pinion shaft. Thus with the torsion spring tightly coiled onto the pinion shaft 18 when in its FIG. 2 position, the pinion shaft is stationery whilst the spring 24 continues to move the piston 23 to the right, this movement also correspondingly causing the piston rod to move to the right, so that as this movement continues the strap 29 is re-tensioned and restored to its FIG. 1 'rigid' connection position, this re-tensioning moving the end of the spring 22 back to its FIG. 1 position, unwinding the coils of the spring from the pinion shaft, and thus allowing continued rotation of the pinion shaft under the force of the spring 24 to be recommenced. Further closing then continues in the normal manner.

It will be appreciated that the degree of 'braking' effected by the spring 22 can be varied as required and need not result in the pinion shaft being held stationery. In the embodiment described, it is of course desirable that the rate of angular movement of the pinion shaft is at least slowed to that at or below the normal closing rate. Accordingly the nature and strengths of the springs 22, 24 respectively can be varied as required.

Another application of the present invention is to various forms of electromagnetic braking whereby, for example, a member equivalent to the strap is moved between respective positions equivalent to the tensioned and reduced-tension positions of the strap by means of an electromagnet, thereby allowing braking, stalling or stopping of the shaft to take place. An arrangement of this type is shown diagrammatically in FIGS. 3 and 4.

The door closer spindle or adapter socket of the spindle, shown at 30 has a coiled torsion spring 31 around it. One end 32 of the spring is held against a suitable fixed part of the arrangement, whilst the other end of the spring is fixed to one end of a link 33. The other end of the link 33 is pivotally connected to one end of a further link 34, the other end of link 34 being pivotally connected to a fixed member 35 of the arrangement. At one side of the common pivot of the links 33 and 34 is an electromagnetic device, comprising a solenoid coil 36, with a keeper 37 which is arranged to move centrally through the coil, the keeper having a 'head' disposed outside of the coil, adjacent the common pivot between the links. The Figures show, in dashed lines, a free or fail safe state of the spring 31 before assembly. On assembly, the straight end section 31*a* of the spring leading to the link 33 is forced to lie at one side of, and against, a stop 38, so as slightly to coil further the spring.

Figure 3:
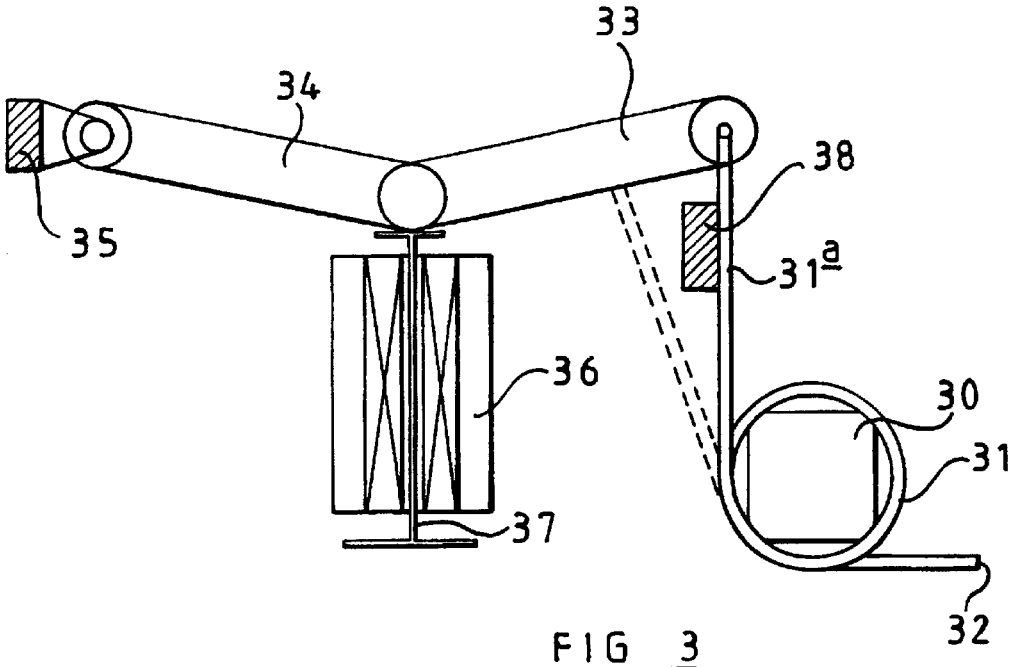
FIG. 3 is a diagrammatic view of an electromagnetic braking arrangement of the invention, with a door closer pinion un-braked.
Figure 4:
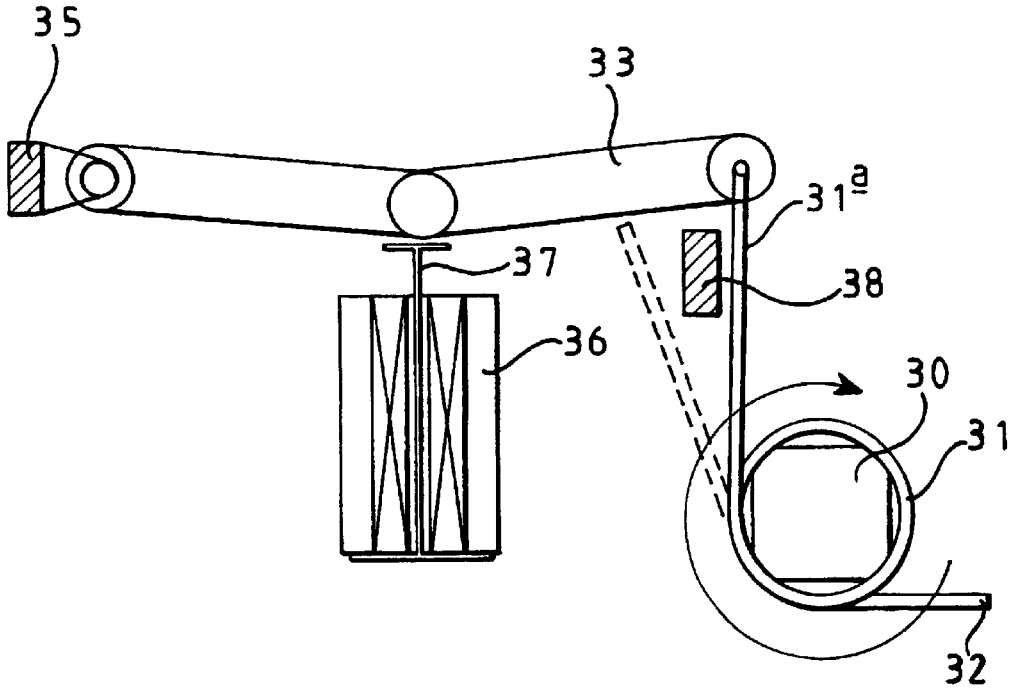
FIG. 4 is a view as in FIG. 3, but showing the pinion braked.

FIG. 3 shows the un-braked position of the pinion, with the solenoid coil de-energised, and the keeper head in its 'inner' position. The section 31*a* of the spring is against its stop 38 and the spring force on the link 33 causes the link 33 to lie at a downwards angle, so that the common pivot is adjacent the 'inner' position of the keeper head. The spring is insufficiently coiled to grip the pinion 30, which can thus freely rotate. If the solenoid is now energised, the keeper is magnetically attracted and moves to its 'outer' position where its head pushes the common pivot of the links in a direction which tries to align the links. This 'straightening' of the two links causes the end of link 33 connected to the spring section 31*a* to move the section off its stop 38, as shown in FIG. 4. This effects a further coiling of the spring, thereby tightening on the pinion and braking, either partially or fully, its angular movement. Upon de-energisation of the solenoid, the spring section 31*a* moves back against its stop, thereby restoring the common pivot to its FIG. 3 position, this restoration pushing the head of the keeper back to its 'inner' position. Accordingly, as the spring is now no longer tight on the pinion, the braking force is removed. The head of the keeper could be connected to the common pivot if required. It may be possible to adapt the arrangement so that the solenoid and keeper could alternatively be arranged to operate with the FIG. 3 state as energised, and the FIG. 4 state as de-energised. The arrangement described can operate as a brake system for an electromagnetic hold-open device for a door.

The type of arrangement of FIGS. 3 and 4, where there would be the usual 'rigid' connection between the door closer piston and the pinion, could be part of the door closer, or could be an 'add-on' self-contained unit. It could fit on the underside of the closer body at the lower end of the pinion, i.e. at the opposite side of the body from the closer arm. If desired, the braking could be arranged to operate automatically, for example upon excessive closing force being applied, as in the embodiment of FIGS. 1 and 2, by relating energisation of the solenoid to the sensing of any such force. However, application of braking by means of the arrangement of FIGS. 3 and 4 could instead be non-automatic, for example operator controlled.

Figure 2:
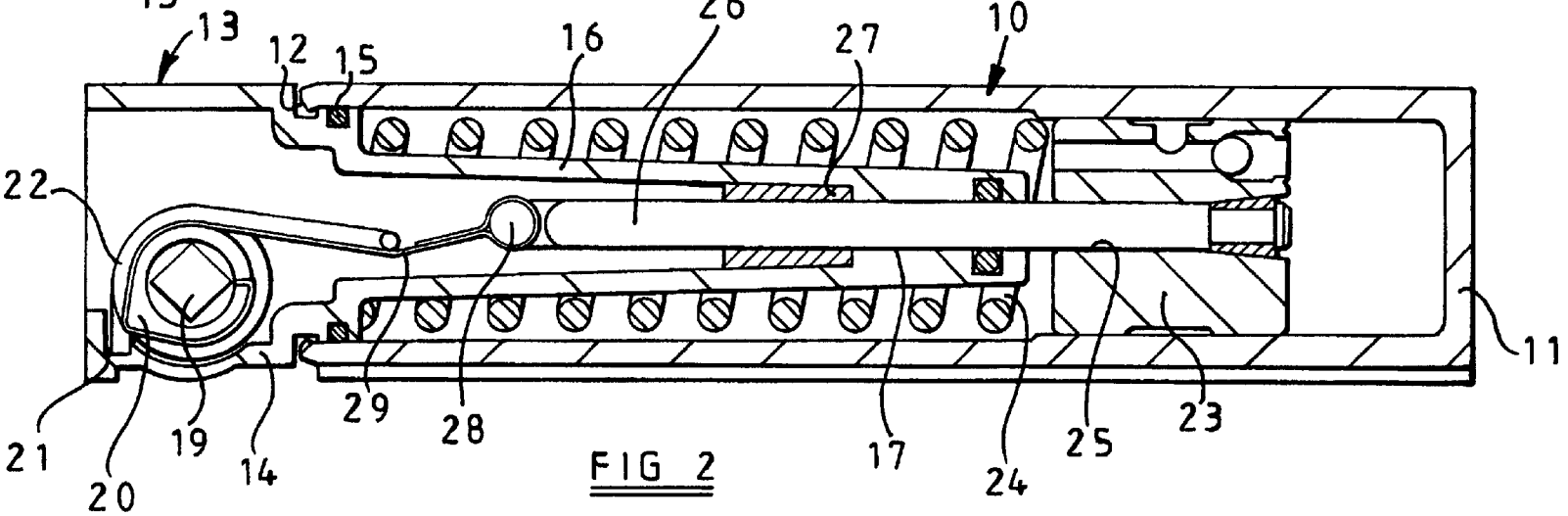
FIG. 2 is a view like FIG. 1, showing how a pinion of the door closer is locked if a force is applied to the door to try to close it too quickly.

It will be appreciated that whilst in the embodiment of FIGS 1 and 2 the connecting strap is normally tensioned, with reduced tension therein leading to braking, the situation is the reverse with the embodiment of FIGS. 3 and 4, where the equivalent to the strap, namely the two links, are normally relaxed or untensioned, with a tensioning, i.e. a 'straightening', leading to braking.

What is claimed is:

1. A door closer having an angularly movable shaft and a control mechanism, the control mechanism including a braking means and a retarding means for applying the braking means to the shaft, characterized in that:

the braking means comprises a torsion spring positioned about a single shaft, the retarding means tightening the torsion spring about the single shaft, the tightening of the torsion spring against the shaft acting to brake the angular movement of the single shaft.

2. The door closer according to claim 1, wherein the retarding means comprises:

a strap connected to the shaft;

a movable hydraulic piston connected to the strap, the piston normally holding the strap in tension relative to the torsion spring, the strap, when in tension, preventing the torsion spring from tightening about the shaft.

3. The door closer according to claim 2, wherein the shaft includes a first portion having a circular cross-sectional shape, the torsion spring being positioned about the first portion, and a second portion having a shaped cam surface to vary the output torque, the strap being connected to the second portion.

4. The door closer according to claim 2, further comprising a compression spring for biasing the movable piston in a first direction.

5. The door closer according to claim 2, wherein a free end of the torsion spring lies along the strap.

6. The door closer according to claim 1, wherein the retarding means comprises:

a linkage mechanism connected to one end of the torsion spring, the linkage mechanism being movable from a normal position to a retarding position, the movement of the linkage mechanism from the normal position to the retarding position tightening the torsion spring about the shaft.

7. The door closer according to claim 6, wherein the linkage mechanism includes at least two linkage arms pivotally connected to one another.

8. The door closer according to claim 6, further comprising an electromagnetic device for moving the linkage mechanism from the normal position to the retarding position.

9. The door closer according to claim 6, further comprising a stop member positioned adjacent said one end of the torsion spring, the torsion spring resting against the stop member when the linkage mechanism is in the normal position.

* * * * *